United States Patent [19]

Wartman

[11] Patent Number: 4,508,810

[45] Date of Patent: Apr. 2, 1985

[54] LIGHT-DESENSITIZABLE TRANSFER MEDIUM WITH PHOTOOXIDIZABLE REACTANT AND OXYGEN-SENSITIZING DYE

[75] Inventor: Thomas G. Wartman, St. Paul, Minn.

[73] Assignee: Minnesota Mining and Manufacturing Company, St. Paul, Minn.

[21] Appl. No.: 584,493

[22] Filed: Feb. 28, 1984

[51] Int. Cl.[3] ..... G03C 5/54; G03C 1/72

[52] U.S. Cl. ..... 430/201; 430/203; 430/338; 430/523; 430/531; 430/536; 430/262

[58] Field of Search ..... 430/201, 203, 531, 523, 430/536, 338

[56] References Cited

U.S. PATENT DOCUMENTS

| | | | |
|---|---|---|---|
| Re. 27,375 | 5/1972 | Puerckhauer et al. | 430/203 |
| 2,733,994 | 2/1956 | Purdy et al. | 430/404 |
| 3,094,417 | 6/1963 | Workman | 430/203 |
| 3,460,946 | 8/1969 | Puerckhauer et al. | 430/203 |
| 3,799,779 | 3/1974 | Burleigh | 430/203 |
| 4,013,473 | 3/1977 | Willems et al. | 430/203 |
| 4,038,083 | 7/1977 | Willems et al. | 430/203 |
| 4,076,530 | 2/1978 | Takeda et al. | 430/203 |
| 4,168,171 | 9/1979 | Winslow et al. | 430/151 |

OTHER PUBLICATIONS

"Photothermographic Element, Composition and Process", *Research Disclosure*, No. 11821, 2/1974, pp. 13 and 14.

*Primary Examiner*—Richard L. Schilling

*Attorney, Agent, or Firm*—Donald M. Sell; James A. Smith; David L. Weinstein

[57] ABSTRACT

A transfer medium useful for preparing duplicates of originals such as printed matter. The transfer medium comprises a light-transmissive backing sheet, a layer coated on at least one major surface thereof containing a photooxidizable reactant and an oxygen-sensitizing dye in a film-forming binder and, over said layer, a top coat of an oxygen-permeable, low tack adhesive.

Upon imagewise exposure to light, the transfer medium is desensitized in areas corresponding to the light image areas of the original, resulting in a latent image in the areas corresponding to the dark image areas of the original.

The unoxidized photooxidizable reactant is capable of inter-reacting with a second reactant material borne on the surface of a receptor sheet at a conversion temperature between 70° C. and 150° C. to produce a visibly distinct reaction product. The adhesive coating serves to provide close contact between the transfer medium and the original during the exposure step and between the transfer medium and receptor sheet during the image-forming step.

9 Claims, 1 Drawing Figure

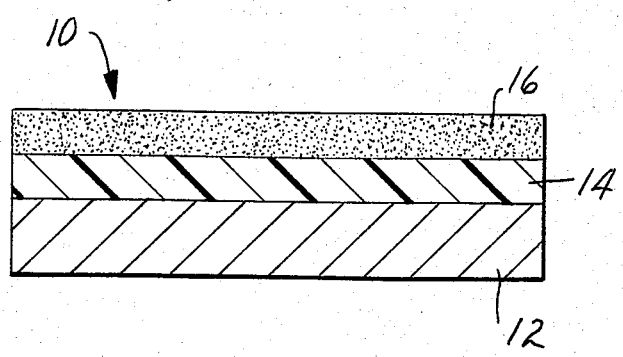
10
16
14
12

LIGHT-DESENSITIZABLE TRANSFER MEDIUM WITH PHOTOOXIDIZABLE REACTANT AND OXYGEN-SENSITIZING DYE

BACKGROUND OF THE DISCLOSURE

This invention relates to media for preparing duplicates of originals such as printed matter and the like.

There exists a need for a means by which copies of original documents can be made outside the usual business office or copy center at reasonable price. Means for "home-copying" currently available today suffer from shortcomings, such as high cost of apparatus and/or media, and inability to copy from two-sided originals. Home-copiers employing xerographic processes are generally expensive initially and are generally demanding of maintenance.

Workman, U.S. Pat. No. 3,094,417, discloses a method of making a copy of a graphic original having differentially radiation-absorptive image and background areas, comprising (1) placing over and in close contact with said original a light-desensitizable colored light-transmissive intermediate film material comprising a transparent film backing having a uniform bonded face-coating including a first reactant and a colored activatible organic photoreducible dye, (2) exposing the original through said film material to visible light of which at least a significant portion of said light is absorbable by said dye for a time and at an intensity sufficient to cause total desensitization of said first reactant at areas corresponding to the least absorptive areas of the original and significantly less than total desensitization at areas corresponding to the most absorptive areas of the original, (3) placing the thus exposed film material in face-to-face close contact with a receptor sheet comprising a paper-like backing sheet having a bonded face-coating comprising a second reactant inter-reactive with said first reactant to produce a visibly distinct colored reaction product when the reactants are briefly heated together at a conversion temperature within the range of about 90° C. to about 150° C., (4) heating to the conversion temperature to produce on said receptor sheet a visible reproduction of image areas of the original, and (5) separating the receptor sheet and the intermediate film.

The foregoing process calls for the exposed film to be placed with its coated surface in contact with the coated surface of the paper receptor sheet and the composite to be pressed between flat glass panels, previously heated to approximately 110° C., for a few seconds, or alternatively the composite to be passed around a heated bar or between squeeze rolls of which one or both is maintained at the required elevated temperature. It would be desirable, from the standpoint of cost, to eliminate the flat glass panels, squeeze rolls, or the like, in the image-forming steps.

Purdy, U.S. Pat. No. 2,733,994, discloses a process of making photographic duplicate of an original which comprises (1) placing on the surface of the original a transparent film carrying a light-sensitive printing-out emulsion and an overlayer of material having a tacky surface, the tacky surface being in contact with the original, (2) exposing the thus covered original to light through the transparent film, and (3) removing the film from the original. The requirement for good contact during exposure was effected by means of a tacky surface in the absence of pressure plates, vacuum frames, and other cumbersome equipment. This patent suggests the use of gelatin as the best adhesive material to use in this process. It also suggests that glycerin be used with gelatin to give desirable tack. Because the adhesiveness or tack of gelatin, even when fortified with a humectant like glycerin will change with changes in relative humidity, the desired degree of tack cannot be maintained over a sufficient range of atmospheric humidity to produce a useful product. Because gelatin is an excellent culture medium for bacteria and molds and is used as such in the laboratory, it is preferred to keep the moisture content of a gelatin-containing product low in order to prevent microbiological attack, e.g. mildew. At low moisture levels, however, gelatin is insufficiently tacky for adhesive purposes. Furthermore, gelatin is not sufficiently permeable to gases to allow a volatizable reactant to diffuse therethrough in order to react with a second reactant on a receptor sheet.

SUMMARY OF THE INVENTION

The present invention involves a transfer medium which comprises a light-transmissive backing sheet, a layer coated on at least one major surface thereof comprising a volatizable, photooxidizable reactant and an oxygen-sensitizing dye in a film-forming binder, and, over said layer, a top coat of an oxygen-permeable, low tack adhesive that is capable of allowing said volatizable substance to permeate therethrough upon application of heat.

By means of reflex light exposure, the photooxidizable reactant of the transfer medium is desensitized in the areas of the medium corresponding to the light image areas of the original, resulting in a latent image in the areas of the medium corresponding to the dark image areas of the original.

To develop the latent image, the transfer medium is placed in face-to-face contact with a receptor sheet which comprises a backing and a layer coated on one major surface thereof, which layer contains a second reactant capable of reacting with the unoxidized photooxidizable reactant of the transfer medium to form a color. Upon application of heat, the unoxidized photooxidizable reactant of the transfer medium volatizes and migrates through the low tack adhesive layer to the receptor sheet layer containing the second reactant. The composite comprising the transfer medium and receptor sheet is then further heated, whereby the latent image is developed into a colored image corresponding to the dark image areas of the original.

The adhesive provides close contact between the transfer medium and original during reflex light exposure, thus eliminating the need for the costly apparatus now used commercially in reflex copiers, e.g. glass panels, squeeze rolls. The adhesive also helps to provide close contact between the transfer medium and receptor sheet so that the reaction between the volatizable, unoxidized photooxidizable reactant of the transfer medium and the second reactant on the receptor sheet occurs uniformly in all areas of the receptor sheet. The adhesive must be sufficiently permeable so that the unoxidized photooxidizable reactant on the transfer medium can migrate therethrough and react with the second reactant on the receptor sheet to form a color. The adhesive must also be sufficiently permeable to oxygen so that the photooxidizable reactant can be oxidized and desensitized in the areas of the transfer medium corresponding to the light image areas of the original.

BRIEF DESCRIPTION OF THE FIGURE

The FIGURE shows an elevation view of the transfer medium according to the present invention.

DETAILED DESCRIPTION OF THE INVENTION

The essential components of the transfer medium 10 are (1) a backing sheet 12, (2) a layer 14 containing a volatizable, photooxidizable reactant and an oxygen-sensitizing dye in a film-forming binder, and (3) over said layer, a top coat 16 of an oxygen-permeable adhesive.

Backing sheets suitable for the transfer medium of the present invention must be transmissive to visible light. The backing sheet can be transparent or translucent to visible light. Materials suitable for the backing sheet of the transfer medium include paper, and polymeric films, such as polyester. A preferred material for the backing sheet is this translucent paper or glassine paper.

Workman, U.S. Pat. No. 3,094,417 describes reactants and reactant systems that are suitable for use as image-forming components in the present invention, and is incorporated herein by reference for that purpose. The reactant systems may be adequately defined by means of certain tests. In all cases the two or more essential reactants undergo permanent visible reaction when they are placed in contact and momentarily heated to the conversion temperature, e.g. 70° C.–150° C., in the thermographic copying process. In addition, the reactants undergo the same color forming reaction when mixed together in solution in a suitable solvent, when gentle heating if necessary; whereas the reaction is prevented when one or another of the reactants, in solution, is first exposed to visible radiation at wavelengths in the near ultraviolet region of about 3000 to about 4200 angstroms.

The test is run as follows. Given a visibly heat-sensitive system consisting essentially of two interreactant materials A and B, material A is first dissolved in an inert liquid solvent at low concentration. The solvent is selected to be non-reactive with either of the reactant materials, and neither absorbs nor is altered by the actinic radiation employed. The concentration of material A is just sufficient to produce a distinctly visible reaction with material B. A portion of the solution, in a small transparent quartz test tube, is exposed to radiation from a BH-6 high pressure mercury arc lamp at 6 inches from the sample for a time up to 45 minutes. A second portion is retained as a control. A small amount of material B is then mixed into each of the irradiated and the nonirradiated portions, with heating on a water bath to about 60° C. where required, and the two solutions are compared for color. A system in which the color of the test solution is widely different or decidedly reduced in intensity from that of the control solution is, by definition, a readily desensitizable system as that term is here employed, and is useful in the practice of the invention.

The reactant present on the transfer medium must be photooxidizable so that upon exposure to light of the proper wavelength, the light-exposed portions of the reactant will be desensitized and rendered incapable of reacting with the second reactant on the receptor sheet when the reactants are in contact in the presence of a sufficient amount of heat to bring about reaction.

A representative example of a reactant system that has been found to be suitable for preparing the transfer medium/receptor sheet system of the present invention is one comprising an alpha naphthol, e.g. 4-methoxy-1-naphthol, and a diazonium salt, e.g. 1-diazo-4-benzoyl amino-2,5-diethoxy benzene ½ zinc chloride. The alpha naphthol is present on the transfer medium, and the diazonium salt is present on the receptor sheet. In the place of a diazonium salt reactant, a normally solid organic acid salt of a noble metal can be used. A representative example of such a salt is silver behenate.

It will be appreciated that other specific reactants may be added to, or substituted in, the foregoing system. As one example, 4-methoxy-1-naphthol can be replaced by 4-methoxy-2-methyl-1-naphthol. Likewise, the diazonium salt reactant can be replaced by other diazonium salts that are capable of forming colors upon application of heat. Examples of these diazonium salts are 1-diazo-4-N,N-diethylamino benzene chloride zinc chloride, 1-diazo-4-(N-methyl-N-hydroxyethyl)aminobenzene chloride ½ zinc chloride, 1-diazo-4-morpholino-benzene chloride ½ zinc chloride, 1-diazo-2,5-diethoxy-4-p-tolymercaptobenzene chloride ½ zinc chloride, 4-diazo-2,5-dimethoxy phenyl morpholine-1/1-zinc chloride. Mixtures of image-forming reactants can also be used in this system.

The incorporation of small amounts of certain sensitizing dyes in intimate admixture with the radiation-susceptible photooxidizable component of the readily desensitizable heat reactive systems as hereinbefore defined makes possible the construction of the transfer medium which can be desensitized by moderate exposure to visible light at wavelengths of about 4200 angstroms, and more significantly, at the higher wavelengths above about 4500 angstroms and including green, yellow and red radiations.

As with the radiation susceptible reactant component, it has been found impossible, in the present state of knowledge, to offer a definitive chemical classification of dyestuffs operable for the purposes of this invention. The problem is made more difficult by the wide complexity of the visibly inter-reactive compositions themselves. However, Workman, U.S. Pat. No. 3,094,417 provides a procedure for distinguishing operable dyes by means of a simple chemical test performed in solution and involving the reduction of silver ion to metal, which procedure will now be described.

A solution is prepared in an inert neutral light-stable liquid solvent, containing, per liter of solution, approximately 0.001 mole of silver nitrate, 0.01 mole of triethanolammonium nitrate (prepared, for example, by neutralizing triethanolamine with nitric acid), and 0.001 mole of the dye. The concentrations are not critical but should be of the indicated order of magnitude. Water is a preferred solvent where the dye to be tested is soluble therein; methanol, dioxane, or mixtures of these with water are useful with dyes which are insoluble or partially soluble in water alone. Two 15 ml portions are placed in Pyrex® test tubes in a waterbath at 50° C. One is protected from light; the other is irradiated for 30 minutes with light from a 500 watt tungsten filament projection bulb at a distance of 8 inches from the sample, i.e. at an intensity of about 60,000 footcandles. The two tubes are then visually compared. The control tube is found to contain a visible trace of precipitated silver, ordinarily as a fine black powder. In the presence of an activatible dye, the amount of silver precipitated from the test solution is significantly increased. Large increases may be estimated visually, or the amounts of precipitate may be determined by quantitative analysis.

Precipitation of silver under test conditions may occur in the form either of dense black flakes or of a silver mirror on the clean wall of the tube. Although not ordinarily required, the silver precipitate can be distinguished from precipitated portions of dye or other materials by its insolubility in excess of organic solvent.

Copious precipitation of silver occurs in the just described test when applied to halogen-containing fluorescent dyes, for example erythrosin, Rose Bengale, D&C Orange 16, and Aizen Acid Phloxine PB, and to pararosaniline dyes, for example Calcozine Violet Ex. Conc. Additional examples of dyes which have been found to be less effective, but still useful for the purposes of the invention, include Eosin OS Purified, Rhodamine B Extra S, Pontacyl Violet S4B, Pontachrome Azure Blue B, Phenosafranine, Fast Fat Blue B, Artisil Orange 3RP, Tinon Yellow GK-F, Calcozine Blue ZF (methylene blue), Aizen New Methylene Blue NHX, Seto Flavine T, proflavine hydrochloride, Azo Scarlet Y, and Kryptocyanine. Mixtures of dyes can be used. In each instance the dye is a colored organic compound which absorbs light in the visible wavelength range above about 4200 angstroms, which causes reduction of silver ion and precipitation of metallic silver under the test conditions hereinbefore described, and which both renders the resulting transfer sheet desensitizable under irradiation with visible light, and also provides a significant increase in the rate of desensitization.

Other dyes suitable for this invention are described in Burleigh, U.S. Pat. No. 3,799,779 and Burleigh, U.S. Pat. No. 3,819,664, both of which are incorporated herein by reference. Burleigh, U.S. Pat. No. 3,799,779 also provides a procedure for distinguishing operable dyes by means of a simple chemical test, which procedure will now be described. A particular dye to be tested is first dissolved in an inert organic solvent selected form the group consisting of chloroform, acetone and ethanol, or mixtures thereof, at a concentration of 0.001 mole per liter. At ambient temperature, the dye solution (100 milliliters in a 200 milliliter open top beaker) is directly exposed to ultraviolet light in the 200–400 nanometer wavelength range using a 70 watt (Spectroline Black Light, Model NO. TF-250) black light at a distance of about 6–8 inches, whereupon visible fluorescence is instantaneously observed for solutions of dyes which are useful in the practice of this invention. When the dye solutions are exposed and observed in the absence of visible light, i.e., in darkness, the fluorescence is very easily observed, and with most dyes tested thus far the fluorescence has been very easily observed even in the presence of visible light. An example of an oxygen-sensitizing dye that is suitable for the present invention is trichloro-diethoxy-isovalanthrene, the formula of which is shown below:

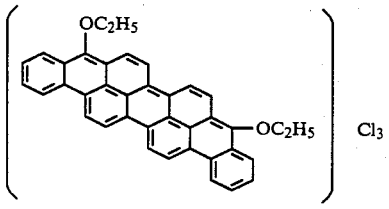

A binder material, normally polymeric, is preferably used to contain the dye-sensitized photooxidizable substance in layers on the sheets of the transfer medium. It is desirable that the binder materials used in the present invention be capable of forming continuous films. Examples of such polymeric binder materials are ethoxylated cellulose derivatives, e.g., ethyl cellulose. Such binder materials are preferably chosen to be compatible with the components incorporated therein, i.e., capable of forming an homogeneous layer with such components, and permit the ready migration of the photooxidizable substance therethrough upon heating.

Adhesives suitable for use in the practice of the present invention must be (1) permeable to the volatizable, photooxidizable reactant present on the transfer medium, (2) permeable to oxygen, (3) non-reactive and non-interfering with the color-forming reactants of the transfer medium and receptor sheet, (4) capable of being stripped away from the receptor sheet without affecting the image formed thereon, (5) capable of being stripped away from the original without affecting the image thereon, (6) sufficiently tacky to provide adequate contact between (a) the transfer medium and the original and (b) the transfer medium and the receptor sheet.

One criterion for selecting an adhesive is that it must be sufficiently permeable to the volatizable, photooxidizable reactant present on the transfer medium so that the reactant can migrate through the adhesive layer to react with the second reactant on the receptor sheet to form a color.

A second criterion for the adhesive is that it must be at least as permeable to oxygen as is the binder for the layer containing the photooxidizable reactant. Because the preferred binder material is ethyl cellulose, the oxygen-permeability of the adhesive should preferably be equal to or greater than the oxygen-permeability of ethyl cellulose.

A third criterion for selecting an adhesive is that it must be suitable for use as a low tack adhesive. Low tack is critical because the adhesive must lift off neither the image nor paper fibers from the original when it is stripped therefrom, nor must it lift off the image from the receptor sheet when it is stripped therefrom.

A fourth criterion for the adhesive is that it must be capable of readhering the transfer medium to the receptor sheet after the medium is stripped away from the original.

A fifth criterion for the adhesive is that it must not interact with the color-forming reactants present on the transfer medium and the receptor sheet.

Polymers that are capable of being formulated into adhesives and that have oxygen-permeability characteristics that are suitable for the present invention are set forth in Table I:

TABLE I[a]

| Polymer | Temp. (°C.) | Oxygen-permeability coefficient, P* |
|---|---|---|
| Polydimethyl siloxane | | |
| RTV silicone | 23 | 440 |
| 10 wt. % silica aerogel filler | 25 | 660 |
| 33 wt. % silica aerogel filler | 25 | 600 |
| (Dimethyl siloxane-phenyl siloxane) copolymer weight percentage dimethyl siloxane | | |
| 95 | 25 | 450 |
| 80 | 25 | 130 |
| 67 | 25 | 45 |
| Nitrile-silicone rubber | 25 | 85 |
| Fluoro-silicone rubber | 25 | 114 |
| Poly-4-methyl pentene-1 | 25 | 24 |
| Poly(cis-isoprene) natural rubber | 25 | 24 |

TABLE I[a-continued]

| Polymer | Temp. (°C.) | Oxygen-permeability coefficient, P* |
|---|---|---|
| Poly(butadiene) (emulsion) | 25 | 20 |
| (Propylene-ethylene) copolymer (55/45) | 25 | 14 |
| (Styrene-butadiene) copolymer weight percentage butadiene | | |
| 86 | 25 | 13 |
| 77 ("Buna-S") | 25 | 17 |
| Ethyl Cellulose | | |
| Unplasticized | 25 | 7.2 |
| 49.5% ethoxyl | 25 | 15.0 |
| Ethyl Cellulose, plasticized (Ethocel) | 25 | 8.0 |

[a]SOURCE: The Science and Technology of Polymer Films, Orville J. Sweeting, ed., Vol. II, (John Wiley & Sons, Inc.: New York), 1971, pp. 85–124.
*The units of P are $[m^1(STP)\text{-}cm/cm^2\text{-}cm^2\text{-}SEC\text{-}cmHG] \times 10^{10}$ The adhesives in Table I can be formulated so as to have the proper degree of tack in order to satisfy the criteria stated previously.

Many polymers do not exhibit the requisite degree of oxygen-permeability to be useful as adhesives for the present invention. Some of these polymers are set forth in Table II:

TABLE II[a]

| Polymer | Temp. (°C.) | Oxygen-permeability coefficient, P* |
|---|---|---|
| (Tetrafluoroethylene-hexafluoropropylene) copolymer (86/14) "FEP Teflon" | 25 25 | 5.9 |
| Cellulose acetate-butyrate (Kodapak F-298) | 25 | 5.6 |
| (Ethylene-vinyl acetate) copolymer weight percentage ethylene | | |
| 85 (Elvax) | 25 | 5.0 |
| (Butadiene-acrylonitrile) copolymer weight percentage butadiene | | |
| 80 | 25 | 4.8 |
| "Perbunan" 73 | 25 | 3.9 |
| "Hycar OR-25" 68 | 25 | 2.3 |

[a]SOURCE: The Science and Technology of Polymer Films, Orville J. Sweeting, ed., Vol. II, (John Wiley & Sons, Inc.: New York), 1971, pp. 85–124.
*The units of P are $[m^1(STP)\text{-}cm/cm^2\text{-}cm^2\text{-}SEC\text{-}cmHG] \times 10^{10}$ An adhesive having an oxygen-permeability coefficient equal to or exceeding the oxygen-permeability coefficient of the binder of the imageable layer of the transfer medium is suitable for the practice of the present invention.

One class of adhesives, silicones, was found to have members with particularly good oxygen-permeability. Specifically, polydimethyl siloxane is about 30 to 90 times more permeable to oxygen then ethyl cellulose, the preferred binder material. In addition, polydimethyl siloxane had adhesive properties that can be adjusted from low tack to high tack by conventional formulation techniques. In general, a low tack adhesive contains from about 60 to about 75 parts tackifying resin per 100 parts silicone gum base.

Dow Corning 282 adhesive (Dow Corning Corporation, Midland, Mich.), a polydimethyl siloxane polymer, is the preferred oxygen-permeable adhesive coating for the transfer medium of the present invention.

The receptor sheet comprises a backing and an imageable layer. The backing can be any suitable material such as plastic film, glass, paper, metal, cloth, wood, etc. Paper is preferred for home-copier purposes. The backing desirably should have a heat-distortion temperature sufficiently high to permit reasonable development temperatures to be used without damage thereto. It is contemplated, however, that backing having lower heat-distortion temperatures may be desirable as, for example, when a wrinkled design pattern is desired. The imageable layer comprises a reactant, generally a diazonium salt, e.g. 1-diazo-4-benzoyl amino-2,5-diethoxy benzene $\frac{1}{2}$ $ZnCl_2$, or a silver salt of a fatty acid, e.g. silver behenate, that is capable of reacting with the volatizable reactant present on the transfer medium.

The latent image on the transfer sheet can be formed by the process of reflex imaging, as described in Kosar, *Light-Sensitive Systems, John Wiley & Sons, Inc.,* (1965), pp. 292. This copying method makes use of a radiation-sensitive layer, coated on a backing that transmits the type of radiant energy capable of activating the radiation-sensitive layer. The backing should be transparent or transclucent to visible radiation. The image to be copied is placed in face-to-face contact with the radiation-sensitive layer, and suitable radiation is sent through the backing which is transmissive to this radiation. A portion of this radiation then passes through the radiation-sensitive layer and strikes the image; light image-areas reflect most of this radiation back to the radiation-sensitive layer, and dark image-areas, relatively little. The radiation-sensitive layer transmits part of this reflected radiation back to the backing. A part of this transmitted radiation, in turn, is then reflected from the surface of the backing, and repeats the path of the original incident radiant energy. This cycle-back-and-forth travel of radiation between the backing of the transfer medium and the image is repeated until all the incident radiant energy has been absorbed. It is preferred that the radiation be panchromatic. Sources of radiation that are suitable include incandescent tungsten lamps and sunlight.

In all reflex light exposure methods good contact between the photosensitive transfer medium and the graphic original is required in order to prevent formation of a fuzzy image or smudged background.

Development of the image is carried out by application of heat. The light-exposed transfer medium is placed over and adhered to the receptor sheet and heated. The unreacted photosensitive thermal transfer material in image areas volatizes and migrates to the receptor sheet, reacts with the chemicals thereon and forms the image. Again, good contact between transfer medium and receptor sheet is required during development or a fuzzy image or incomplete image will result. The low tack adhesive helps to provide the requisite degree of contact.

The low tack adhesive bearing transfer medium allows simplification in the copier to carry out the process. There no longer is the requirement for a glass plate and hinged cover to maintain pressure during light exposure. After the low tack transfer medium is placed on an original, the laminate can be exposed to visible radiation to oxidize the photooxidizable material of the transfer medium. Heat buildup is minimized in the improved process because there is no glass plate to get hot.

Because the low tack transfer medium also adheres to the receptor or receiving sheet, heat development is simplified.

The following, non-limiting, examples further illustrate the invention.

EXAMPLE I

The transfer medium employed was prepared from a T-655 Dual Spectrum sheet, available from Minnesota Mining and Manufacturing Company, St. Paul, Minn. This medium comprised a sheet having a backing made of thin translucent paper, a photooxidizable layer of 4-methoxy-1-naphthol sensitized with erythrosin, magnesium phthalocyanine, and trichloro-diethoxy-isovalanthrene in an ethyl cellulose binder coated upon said backing, said photooxidizable layer being overcoated with polydimethyl siloxane adhesive (Dow Corning 282, available from Dow Corning Corporation). The adhesive had been diluted to 25% solids with heptane prior to coating. The adhesive coating weight was approximately 3.2 g/m$^2$.

A 5 in.×8 in. sample of the foregoing adhesive-coated transfer medium was adhered to an original to provide a laminate the adhesive side of the transfer medium being in contact with printed side of the original. The laminate was placed on a white table-top, with the back of the original facing away from the table-top over the laminate, and the transfer medium was exposed to a 200-watt incandescent lamp at a distance of 20–30 cm for 12 seconds.

The exposed transfer medium was peeled away from the original and was then pressed on and adhered to a receptor sheet containing Andrews #12 diazo obtained from Andrews Paper and Chemical Company, Inc., Port Washington, N.Y., the adhesive side of the transfer medium being in contact with the chemical-bearing side of the receptor sheet.

The diazo copy paper had been made by coating a solution containing 35.4% ZnO, 35.4% polyvinyl butyral resin (Butvar®B72), 22.7% diphenyl phthalate, 2.9% 5 sulfo salicyclic acid and 3.6% Andrews #12 diazo diazonium salt in a methanol-toluene solvent on a 37 lb. No. M.F. paper from Nekoosa Edwards Paper Company. The structure of Andrews #12 diazo is 1-diazo-2,5-diethoxy-4 benzoyl aniline ½ zinc chloride. A coating weight of about 8.6 g/m$^2$ was obtained.

The laminate of transfer medium and receptor sheet was placed on a base having a slight curvature and then overlayed with a black infrared absorbing cloth.

The curvature (a 10 cm length with a radius of curvature of 50.2 cm) insured that the laminate would lay flat and not buckle during heat development.

The laminate was exposed to a 200-watt light at a distance of 20–30 cm for 1¼ minutes. The black cloth absorbed sufficient light during this period to provide sufficient heat to cause a coupling reaction between the 4-methoxy-1-naphthol in the transfer medium and the diazonium salt in the receptor sheet.

A copy with purple image and yellow background was obtained. After room light exposure the background bleached to a grey color while the image remained purple colored.

EXAMPLE II

A laminate comprising the transfer medium of Example I and an original was reflex exposed according to the procedure of Example I.

The transfer medium was peeled away from the original and placed over a sheet of T-658 Dual Spectrum copy paper, available from Minnesota Mining and Manufacturing Company, and described in U.S. Pat. No. Re. 27,375, incorporated herein by reference for the description thereof, the adhesive side of the transfer medium being in contact with the chemical-bearing side of the receptor sheet.

The thus-formed laminate was then heated at a temperature of 124° C. for 5 seconds to obtain a copy of the original.

Various modifications and alterations of this invention will become aparent to those skilled in the art without departing from the scope and spirit of this invention, and it should be understood that this invention is not to be unduly limited to the illustrative embodiments set forth herein.

What is claimed is:

1. A transfer medium comprising, (a) a backing sheet having a uniform face-coating including a volatizable, photooxidizable reactant and an oxygen-sensitizing dye in a film-forming binder, said photooxidizable reactant being capable of inter-reacting with a second reactant material borne on the surface of a receptor sheet at a conversion temperature between about 70° C. and about 150° C. to produce a visibly distinct reaction product, said photooxidizable reactant capable of being desensitized in an image-wise manner upon exposure of the transfer medium to a visible light image pattern, (b) said face-coating being overcoated with an adhesive coating, said adhesive coating being sufficiently permeable to permit said photooxidizable reactant to migrate therethrough upon exposure to heat, whereby said photooxidizable reactant reacts with said second reactant to form a color, said adhesive coating further being sufficiently permeable to oxygen to allow said photooxidizable reactant to be exposed to sufficient oxygen to be desensitized in an image-wise manner upon exposure to visible light, said adhesive coating being sufficiently tacky to provide close face-to-face contact between said transfer medium and an original and between said transfer medium and said receptor sheet, said adhesive coating further being capable of being stripped away from both said original without affecting the image thereon and said receptor sheet without affecting the image formed thereon, and said adhesive coating being non-reactive with and non-interfering with said photooxidizable reactant and said second reactant material.

2. The transfer medium of claim 1 wherein said adhesive coating is prepared from a polymer that has a level of oxygen-permeability equal to or greater than said film-forming binder.

3. The transfer medium of claim 1 wherein said adhesive coating comprises a silicone polymer.

4. The transfer medium of claim 3 wherein said silicone polymer is a polydimethyl siloxane.

5. The transfer medium of claim 1 wherein said photooxidizable reactant is an alpha naphthol.

6. The transfer medium of claim 5 wherein said alpha naphthol is 4-methoxy-1-naphthol.

7. A copy-sheet system comprising (a) the transfer medium of claim 1, and (b) a receptor sheet bearing said second reactant material.

8. The system of claim 7 wherein said second reactant material is a reducible silver soap.

9. The system of claim 7 wherein said second reactant material is a diazonium salt.

* * * * *

UNITED STATES PATENT AND TRADEMARK OFFICE

CERTIFICATE OF CORRECTION

PATENT NO. : 4,508,810

DATED : April 2, 1985

INVENTOR(S) : Thomas G. Wartman

It is certified that error appears in the above-identified patent and that said Letters Patent is hereby corrected as shown below:

Col. 3, line 20, "this" should read --thin--.

Col. 9, line 49, "1 1/4" should read --1 3/4--.

Signed and Sealed this

*Ninth* Day of *July 1985*

[SEAL]

*Attest:*

DONALD J. QUIGG

*Attesting Officer* *Acting Commissioner of Patents and Trademarks*